United States Patent [19]

Setteducati

[11] Patent Number: 4,854,591

[45] Date of Patent: Aug. 8, 1989

[54] THREE DIMENSIONAL PUZZLE EMPLOYING A REFLECTIVE SURFACE

[76] Inventor: Mark Setteducati, 218 E. 17th St., New York, N.Y. 10011

[21] Appl. No.: 11,965

[22] Filed: Feb. 6, 1987

[51] Int. Cl.[4] ..... A63F 9/12

[52] U.S. Cl. ..... 273/157 R; 272/8 M

[58] Field of Search ..... 273/157 R; 272/8 M; 434/155; 446/219

[56] References Cited

U.S. PATENT DOCUMENTS

| | | | |
|---|---|---|---|
| 169,882 | 11/1875 | Adams | 273/157 R |
| 2,406,743 | 9/1946 | Crowson | 272/8 M U X |
| 2,483,901 | 10/1949 | Harris | 272/8 M |
| 3,433,485 | 3/1969 | Renn et al. | 273/157 R |

FOREIGN PATENT DOCUMENTS

| | | | |
|---|---|---|---|
| 633951 | 12/1949 | United Kingdom | 273/157 R |
| 1278192 | 6/1972 | United Kingdom | 272/8 M |

*Primary Examiner*—Anton D. Dechsle

*Attorney, Agent, or Firm*—Baker & McKenzie

[57] ABSTRACT

A three-dimensional puzzle comprising puzzle elements and a reflective surface. In one embodiment, the puzzle elements comprise cubes having visual material thereon. When the cubes are correctly arranged on the reflective surface, the visible cube visual material and the reflection of the cube visual material form a composite image solution. In a second embodiment, the puzzle elements are in the form of relatively flat tiles having visual material on their major surfaces. When the tiles are correctly arranged on a flat surface adjacent the upstanding reflective surface, the visual material on the tiles and the reflection of the visual material combine to form a composite image.

8 Claims, 1 Drawing Sheet

Fig. 1.
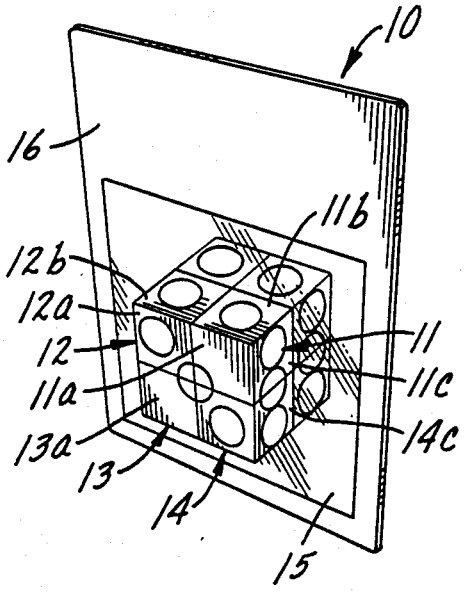
Fig. 2.
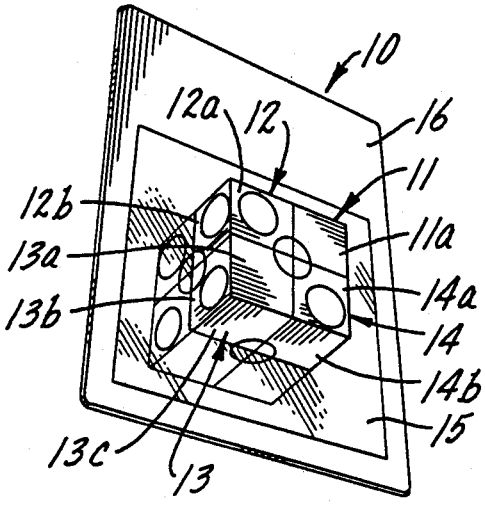
Fig. 3.
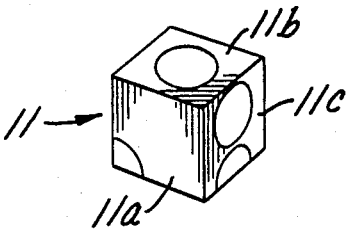
Fig. 4.
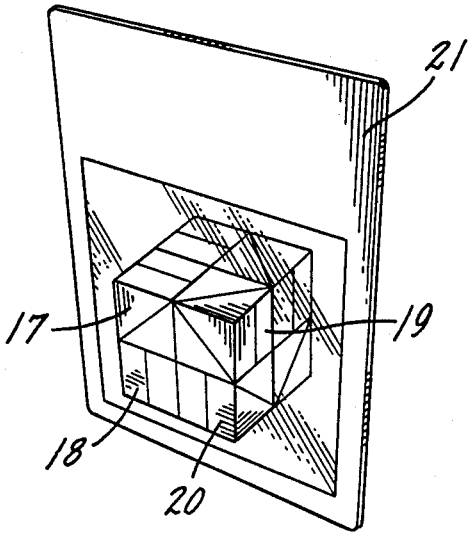
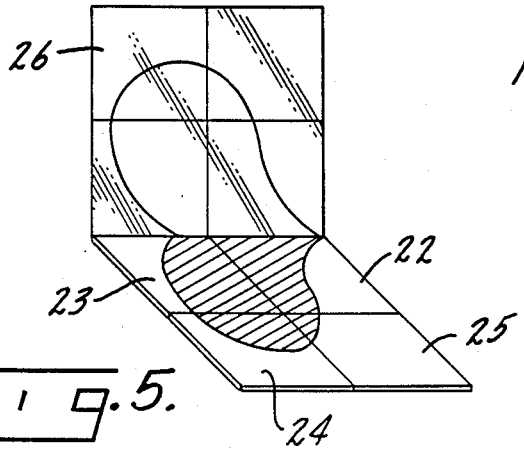
Fig. 5.

THREE DIMENSIONAL PUZZLE EMPLOYING A REFLECTIVE SURFACE

TECHNICAL FIELD

This invention relates to a three-dimensional puzzle. More particularly, this invention relates to a puzzle which comprises a plurality of geometric shapes or forms arranged by the puzzler on or adjacent to a mirror or reflective surface to create a predetermined design or visual format utilizing visual material on a plurality of outer surfaces of the geometric shapes or forms, together with the images of said visual material as they appear in the mirror or reflective surface. In one specific aspect, a plurality of cubes having visual material on a plurality of outer surfaces is arranged in a predetermined arrangement on a reflective surface to form such a predetermined design or visual format. In another aspect, flat geometric shapes with visual material on one or more sides are positioned adjacent to a vertically positioned mirror so that the visual material and the reflection of said visual material together form a predetermined design or visual format.

BACKGROUND OF THE INVENTION

Puzzles, including three-dimensional puzzles, are well-known in the art and exist in a number of formats. The most well-known format, perhaps, is where the puzzler arranges geometric shapes bearing visual material into a predetermined design or visual format. In one format, in order to solve the puzzle, the puzzler arranges the individual puzzle pieces into a predetermined geometric form, i.e., the individual pieces interlock or interact with each other to create a geometric form, such as a cube, a pyramid or the like. In another format, the puzzle is comprised of individual geometric forms having visual material, such as colors or other indicia on a plurality of said forms' exterior surfaces. The puzzler arranges the individual forms into a larger geometric form so that when the individual forms are in a predetermined arrangement, the visual material creates a predetermined design or visual format.

Numerous examples of the latter format exist in the art, including U.S. Pat. No. 4,508,347 (Shettler); U.S. Pat. No. 4,210,333 (Shanin); U.S. Pat. No. 3,771,795 (Flanigen); U.S. Pat. No. 3,638,949 (Thompson); and U.S. Pat. No. 4,189,151 (Klopfenstein). In all of these embodiments, the puzzle consists of a plurality of cubes; the puzzler arranges the individual cubes into a larger three-dimensional cube, a parallelepiped or other geometric form. To solve the puzzle, the puzzler must arrange the cubes to create a predetermined design or visual format utilizing the visual material appearing on a plurality of the cubes' exterior surfaces. Some puzzles have more than one solution, i.e., more than one predetermined arrangement of the individual pieces exists, with each arrangement resulting in a different predetermined design or visual format.

The puzzles disclosed in these references, as well as other three-dimensional puzzles, only utilize, as part of the puzzle's solution, the visual material on a plurality of the exterior surfaces of the geometric shapes or forms which make up the pieces of the puzzle. My invention, however, requires the puzzler to arrange the individual geometric shapes or forms on or adjacent to a mirror or reflective surface and incorporate into the solution of the puzzle the images of the visual material on the surfaces of said geometric shapes or forms which appear in the mirror or reflective surface.

SUMMARY OF THE INVENTION

The present invention contemplates a puzzle comprising a plurality of individual geometric forms, such as cubes, rectangles, parallelepipeds, cones and the like and a mirror or other reflective surface. Each of the individual geometric forms have visual material printed, embossed or otherwise affixed to a plurality of the forms' exterior surfaces.

The puzzler arranges the individual geometric forms into a larger predetermined geometric form on the reflective surface. The visual material on the exterior surface of the individual geometric forms is such that, when the puzzler arranges the larger predetermined geometric form, the visual material and the image of the visual material as they appear in the reflective surface, together create a predetermined design or visual format.

The present invention also contemplates a puzzle wherein the geometric forms are uniform in size and shape, for example, when the geometric forms are cubes.

In another aspect, the present invention contemplates a puzzle which has various solutions, i.e., given a fixed set of individual geometric forms, different predetermined designs or visual formats can be created by the visual material on certain exterior surfaces of said forms together with the images of said material in the reflective surface, by altering the arrangement of the geometric forms.

In another aspect, the invention contemplates a plurality of relatively flat geometric shapes with visual material on the exterior surfaces of said shapes, and one or more mirrors or reflective surfaces positioned adjacent to said shapes at an angle of 90° or less. The puzzler arranges the shapes into a predetermined arrangement so that the visual material, and the images of the visual material as they appear in the mirror or other reflective surface together form a predetermined design or visual format.

DESCRIPTION OF THE DRAWINGS

FIG. 1: a top perspective view of four cubes arranged on a mirror or reflective surface forming the pattern of a single die, showing the three, four and six numbers.

FIG. 2: a bottom perspective view of four cubes arranged on a mirror or reflective surface forming a single die showing the one, three and five numbers.

FIG. 3: a top perspective view showing a cube.

FIG. 4: a top perspective view of four cubes arranged on a mirror or reflective surface forming a plurality of arrows.

FIG. 5: a perspective view of flat tiles arranged adjacent to a vertically positioned mirror forming a predetermined pattern.

DETAILED DESCRIPTION OF THE PREFERRED EMBODIMENTS

FIG. 1 shows a completed puzzle with a particular predetermined design created by the visual material on the exterior surfaces of four cubes together with the images of that visual material as they appear in the reflective surface on which the cubes rest. The puzzle is designated generally as (10) and comprises four individual cubes (11), (12), (13) and (14) of substantially identical size and shape. The blocks are arranged on a mirror or other type of reflective surface (15). In this embodiment, the reflective surface is fixed to a relatively flat member (16).

Three of the exterior surfaces of the cubes (11), (12), (13) and (14) bear visual material which comprise the puzzles' solution. In this case, the visual material are dots, or portions of dots, color contrasted to the color of the remainder of the cubes' surface. When the cubes (11), (12), (13) and (14) are arranged in a predetermined manner on the reflective surface 15), the visual material on the cubes' exposed exterior surfaces (11(*a*), 11(*b*), 11(*c*), 12(*a*), 12(*b*), 12(*c*), 13(*a*), 13(*b*), 13(*c*) and 14(*a*), 14(*b*), 14(*c*)), together with the images of said material in the reflective surface (15) creates a predetermined design, in this case, a single playing die as illustrated in FIG. 1 and FIG. 2. FIG. 1 is a top view of the puzzle (10) showing the three, four and six numbers of the die. FIG. 2 is a bottom view of the puzzle (10) from the opposite direction, and shows the one, three and five numbers.

FIG. 3 depicts cube (11) in a larger scale and shows the three surfaces (11(*a*), 11(*b*) and 11(*c*)) which contain visual material forming part of the predetermined design. The three surfaces of cube (11) not pictured, are blank or contain visual material not part of this particular predetermined design.

The puzzler is given the four cubes in a random arrangement. In order to solve the puzzle, the puzzler must orient and arrange the individual cubes on the reflective surface to create the predetermined visual design, in this case a playing die. If the individual pieces are not arranged properly in the predetermined arrangement, a random design will result because the correct exterior surfaces are not exposed and/or the surfaces are not in the appropriate predetermined relationship to one another.

FIG. 4 depicts a different embodiment utilizing four cubes (17), (18), (19) and (20), arranged on a reflective surface. The reflective surface is fixed to a relatively flat support member (21). A plurality of the exterior surfaces of the cubes bear visual material so, as in FIG. 1 and 2, when the cubes (17), (18) (19) and (20) are arranged in a predetermined manner on the reflective surface, the visual material and the images of that visual material as they appear in the reflective surface together create a predetermined design or visual format. In this case, the design is comprised of a plurality of arrows which appear on the exterior faces of the larger cube formed by the arrangement of the individual cubes (17), (18), (19) and (20).

The solutions for the puzzles in FIG. 1, 2 and 4 require only three of the available six surfaces of the cubes; three surfaces of each cube are not exposed and are not part of the puzzles' solutions. FIG. 3 shows the three surfaces of cube (11), 11(*a*), 11(*b*) and 11(*c*)) which are part of the solution; the three surfaces which are not shown, are not part of the solution. Therefore, each puzzle could have a second solution utilizing visual material appearing on the three surfaces of the individual cubes which are not exposed in the solutions shown in FIGS. 1, 2 and 4.

FIG. 5 shows four relatively flat tiles, (22), (23), (24) and (25), bearing visual material on their flat surfaces. The flat tiles are arranged adjacent to a vertically positioned mirror (26) so that the visual material is reflected in the mirror. The puzzler must arrange the flat pieces into a predetermined arrangement so that the visual material, together with the reflection of said visual material, form a predetermined design, in this case a heart.

The individual geometric shapes of the instant invention can consist of any natural or synthetic material including, but not limited to wood, plastic, compressed paper, polyethelene foam and the like. In the case of puzzles designed for use by children, the material should be sufficiently sturdy to withstand normal and intended use and abuse. The reflective surface can consist of glass or any polished surface such as polished metallic surfaces, wherein the images of the visual material on the geometric shapes can be clearly perceived by the puzzler.

The utilization of the mirror images of the visual material which appear on the surfaces of the puzzle's individual geometric forms increases the difficulty and complexity of the solution, and increases the enjoyment of the puzzler. The use of a mirror or reflective surface also has an educational aspect when the game is played by children, who learn to understand and utilize the concept of mirror images. The complexity of the puzzle may vary depending on the nature of the puzzle's components including, inter alia, the number of individual geometric forms or shapes which comprise the puzzle pieces, the number of potential solutions possible within a given set of geometric forms or shapes, the nature of the printed material which appears on the exterior surfaces of the individual geometric forms or shapes, the shape of the individual geometric forms, and the shape of the geometric form which results from the predetermined arrangement of the individual geometric forms.

For example, increasing the number of the individual geometric forms which comprise the pieces of the puzzle generally increases the complexity of the solution. Although one of the preferred embodiments utilizes cubes which are substantially the same size and shape, a puzzle comprised of geometric forms which are not uniform is also possible. In that case, the solution of the puzzle consists of determining the specific arrangement of the individual geometric forms in order to create the predetermined larger geometric form. The puzzler must, of course, create a geometric form wherein the visual material on the exterior surfaces of the form, together with the images of said visual material as they appear in the reflective surface, results in the predetermined design or visual format.

The figures set forth herein illustrate only three of the virtually unlimited numbers of designs or visual formats which could potentially be utilized. The nature of the visual material appearing on the exterior surfaces, and the ultimate predetermined design or visual format affects the complexity and difficulty of the puzzle. The complexity of the puzzle and the difficulty of the solution increases as the simplicity of the predetermined design increases. A simple design will contain less visual material on each geometric form which is part of the solution making it more difficult for the puzzler to orient and arrange the pieces into the predetermined arrangement.

A puzzle with more than one solution is also possible as discussed in connection with FIGS. 1, 2 and 4. In any one arrangement of the individual geometric forms which comprise the pieces of the puzzle, some exterior surfaces of said forms will be obscured and do not constitute part of the puzzle's solution. Hence, different predetermined arrangements of the individual geometric forms results in different predetermined designs or visual formats. The number of potential solutions increases as the number of individual geometric forms which comprise the pieces of the puzzle increases.

The foregoing general discussion and examples are intended to be illustrative of the present invention, and are not to be considered as limiting. Other variations within the spirit and scope of this invention are possible and will present themselves to those skilled in the art.

I claim:

1. A three-dimensional puzzle comprising a plurality of geometric forms with visual material on a plurality of the exterior surfaces of said forms, wherein the visual material on each of said geometric forms is unique with respect to the visual material on at least one other of said geometric forms, and a reflective surface wherein said visual material is such that in a redetermined arrangement of said forms on said reflective surface the visual material, and the image of the visual material as they appear in the reflective surface, together form a predetermined design.

2. The puzzle of claim 1 wherein said geometric forms consist of cubes.

3. The puzzle of claim 1 wherein said visual material on the plurality of said geometric forms is such that when said forms are arranged in a plurality of predetermined arrangements, the visual material, together with the image of said material as it appears in the reflective surface, form a different predetermined design or visual format depending on the arrangement of the forms.

4. A three-dimensional puzzle comprising four cubes substantially uniform in size and shape with visual material on a plurality of the exterior surfaces of said cubes, and a reflective surface wherein the visual material is such that in a predetermined arrangement of said cubes on said reflective surface, the visual material and the image of the visual material as they appear in the reflective surface together form a predetermined design or visual format.

5. The puzzle of claim 4 wherein the predetermined design or visual format is a playing die.

6. The puzzle of claim 4 wherein the predetermined design or visual format is a plurality of arrows.

7. A three-dimensional puzzle comprising a plurality of geometric forms with visual material on a plurality of the exterior surfaces of said forms, wherein the visual material on each of said geometric forms is unique with respect to the visual material on all other said geometric forms, and a reflective surface wherein said visual material is such that in a predetermined arrangement of said forms on said reflective surface, the visual material and the image of the visual material as they appear in the reflective material, together form a predetermined design.

8. The puzzle of claim 7 wherein said geometric forms consist of cubes.

* * * * *